US008099940B2

(12) United States Patent
Twardochleb et al.

(10) Patent No.: US 8,099,940 B2
(45) Date of Patent: Jan. 24, 2012

(54) LOW CROSS-TALK GAS TURBINE FUEL INJECTOR

(75) Inventors: Christopher Zdzislaw Twardochleb, Alpine, CA (US); John Frederick Lockyer, San Diego, CA (US); Mario Eugene Abreu, Poway, CA (US)

(73) Assignee: Solar Turbines Inc., San Diego, CA (US)

( * ) Notice: Subject to any disclaimer, the term of this patent is extended or adjusted under 35 U.S.C. 154(b) by 517 days.

(21) Appl. No.: 12/314,904

(22) Filed: Dec. 18, 2008

(65) Prior Publication Data

US 2010/0154424 A1 Jun. 24, 2010

(51) Int. Cl.
*F02G 3/00* (2006.01)

(52) U.S. Cl. ..... 60/39.094; 60/39.463; 60/737; 60/742

(58) Field of Classification Search ..... 60/39.094, 60/39.465, 737, 740, 742, 748; 239/404, 239/405, 406, 419, 419.3
See application file for complete search history.

(56) References Cited

U.S. PATENT DOCUMENTS

| | | | | |
|---|---|---|---|---|
| 2,907,527 | A | 4/1956 | Cummings | |
| 2,968,925 | A | 1/1961 | Blevans | |
| 3,610,537 | A | 10/1971 | Nakagawa et al. | |
| 4,311,277 | A | 1/1982 | Stratton | |
| 4,854,127 | A | 8/1989 | Vinson et al. | |
| 4,946,475 | A * | 8/1990 | Lipp et al. | 48/86 R |
| RE33,896 | E * | 4/1992 | Maghon et al. | 431/284 |
| 5,222,357 | A | 6/1993 | Eddy et al. | |
| 5,836,163 | A * | 11/1998 | Lockyer et al. | 60/737 |
| 5,850,732 | A | 12/1998 | Willis et al. | |
| 6,016,658 | A | 1/2000 | Willis et al. | |
| 6,070,411 | A * | 6/2000 | Iwai et al. | 60/737 |
| 6,073,436 | A | 6/2000 | Bell et al. | |
| 6,161,778 | A * | 12/2000 | Haruch | 239/290 |
| 6,354,072 | B1 | 3/2002 | Hura | |
| 6,405,523 | B1 | 6/2002 | Foust et al. | |
| 6,609,380 | B2 * | 8/2003 | Mick et al. | 60/776 |

(Continued)

FOREIGN PATENT DOCUMENTS

| | | |
|---|---|---|
| EP | 1614967 | 1/2006 |

(Continued)

*Primary Examiner* — Louis Casaregola
*Assistant Examiner* — Phutthiwat Wongwian
(74) *Attorney, Agent, or Firm* — Finnegan, Henderson, Farabow, Garrett & Dunner LLP

(57) ABSTRACT

A pilot assembly for a fuel injector of a gas turbine engine may include a longitudinal passageway having an outlet end. A mass flow in the longitudinal passageway may generally flow towards the outlet end during operation of the engine. The pilot assembly may also include a liquid fuel nozzle that is positioned to direct a mixture of liquid fuel and air near the outlet end, and a compressed air inlet that is configured to direct air compressed by a compressor of the engine to a compressor discharge pressure into the longitudinal passageway without a substantial loss of pressure. The longitudinal passageway may also include a flow restriction section. The flow restriction section may be a narrowed section of the longitudinal passageway, in which an upstream side of the flow restriction section may have compressed air at substantially the compressor discharge pressure and a downstream side may have air at a lower pressure and a higher velocity. The pilot assembly may further include a nozzle for injecting one of assist air or gaseous fuel into the longitudinal passageway. The nozzle may be positioned at the flow restriction section or on an upstream side of the flow restriction section to reduce cross-talk.

20 Claims, 4 Drawing Sheets

U.S. PATENT DOCUMENTS

| | | | |
|---|---|---|---|
| 6,732,531 | B2 | 5/2004 | Dickey |
| 6,986,255 | B2 | 1/2006 | Smith et al. |
| 7,036,302 | B2 | 5/2006 | Myers Jr. et al. |
| 7,117,678 | B2 | 10/2006 | Sampath et al. |
| 2002/0162333 | A1 | 11/2002 | Zelina |
| 2007/0044477 | A1 | 3/2007 | Held et al. |

FOREIGN PATENT DOCUMENTS

| | | |
|---|---|---|
| EP | 1760403 | 3/2007 |
| EP | 1944547 | 7/2008 |
| GB | 2175993 | 12/1986 |
| WO | 03/054447 | 7/2003 |

* cited by examiner

LOW CROSS-TALK GAS TURBINE FUEL INJECTOR

TECHNICAL FIELD

The present disclosure relates generally to a fuel injector, and more particularly, to a low cross-talk gas turbine fuel injector.

BACKGROUND

Gas turbine engines (GTEs) produce power by extracting energy from a flow of hot gas produced by combustion of fuel in a stream of compressed air. In general, GTEs have an upstream air compressor coupled to a downstream turbine with a combustion chamber (combustor) in between. Energy is produced when a mixture of compressed air and fuel is burned in the combustor, and the resulting hot gases are used to spin blades of a turbine. In typical GTEs, multiple fuel injectors direct the fuel to the combustor for combustion. Combustion of typical fuels results in the production of some undesirable constituents, such as $NO_x$, in GTE exhaust emissions. Air pollution concerns have led to government regulations that regulate the emission of $NO_x$ in GTE exhaust. One method used to reduce $NO_x$ emissions of GTEs is to use a well mixed lean fuel-air mixture (fuel-air mixture having a lower fuel to air ratio than the stoichiometric ratio) for combustion in the combustor. However, in some cases, using a lean fuel-air mixture may make combustion in the combustor unstable. To provide a stable flame while meeting $NO_x$ emission regulations, some fuel injectors direct separate streams of a lean fuel-air mixture and a richer fuel-air mixture to the combustor. The lean fuel-air mixture may provide low $NO_x$ emissions, while the richer fuel-air mixture may provide flame stabilization during periods of flame instability.

In some cases, the fuel injector may also be configured to direct both a liquid and a gaseous fuel to the combustor. Such a fuel injector, called a dual fuel injector, may enable the GTE to operate using both liquid fuel (such as, for example, diesel) and gaseous fuel (such as, for example, natural gas), depending upon the conditions and economics of any particular GTE operating site. In dual fuel injectors, one of a liquid or a gaseous fuel may be directed to the fuel injector to be mixed with air, and delivered to the combustor. Such a dual fuel injector may include both liquid fuel supply lines and gaseous fuel supply lines, along with suitable valves, to enable the liquid fuel supply to the injector to be switched off while the GTE is operating on gaseous fuel, and the gaseous fuel supply to the injector to be switched off while the GTE is operating on liquid fuel. However, even when the liquid or gaseous fuel is switched off, the corresponding fuel lines may still fluidly couple the multiple injectors of the GTE to each other. Minor variations in the air-fuel mixture (fuel to air ratio, amount of flow, etc.) delivered to the combustor through different fuel injectors may cause variations in the flame at the outlet (inlet into the combustor) of the different fuel injectors. These variations in the flame may cause pressure variations between the outlets of different fuel injectors (combustion induced circumferential pressure variation). The variation in pressure between the different injector outlets may cause ingestion of fuel and/or combustion gases into the inactive fuel lines. This inflow of fuel and/or hot combustion gases through the inactive fuel lines of one fuel injector and outflow through a second fuel injector is called cross-talk. Cross-talk may cause the fuel delivery system to become hot and cause damage.

U.S. Patent Publication number 2007/0044477A1 ('477 publication) to Held et al. discloses a gas turbine engine fuel nozzle that is configured to reduce cross-talk. The fuel nozzle of the '477 publication includes a first, a second, and a third passage extending coaxially along an axis of symmetry of the nozzle. The first, second, and third passageways include a nozzle at one end that extends into the combustor. Each of the passageways of the nozzle of the '477 publication also includes an inlet opening that is fluidly coupled to the combustor. The two innermost passageways of the '477 publication direct a fuel to the combustor. The outermost passageway of the '477 publication is configured to direct steam to the combustor, and includes an additional inlet opening upstream of the nozzle. The inlet openings of the third passageway are located in such a manner that a pressure differential across the inlet openings facilitates providing the driving pressure for a purge flow across the nozzle tip and protection against circumferential pressure gradients that may tend to induce cross-talk. While the approach of the '477 publication may reduce cross-talk in some applications, it may have disadvantages. For instance, it may not be applicable to a gas turbine engine application that does not include steam in the fuel supply system. Additionally, the approach of the '477 publication may not reduce cross-talk in a dual fuel injector where fuel lines associated with one type of fuel may be inactive when the turbine engine is operating using the other type of fuel.

SUMMARY OF THE DISCLOSURE

In one aspect, a pilot assembly for a fuel injector of a gas turbine engine is disclosed. The pilot assembly may include a longitudinal passageway having an outlet end. A mass flow in the longitudinal passageway may generally flow towards the outlet end during operation of the engine. The pilot assembly may also include a liquid fuel nozzle that is positioned to direct a mixture of liquid fuel and air near the outlet end, and a compressed air inlet that is configured to direct air compressed by a compressor of the engine to a compressor discharge pressure into the longitudinal passageway without a substantial loss of pressure. The pilot assembly may also include a flow restriction section. The flow restriction section may be a narrowed section of the longitudinal passageway, in which an upstream side of the flow restriction section may have compressed air at substantially the compressor discharge pressure and a downstream side may have air at a lower pressure and a higher velocity. The pilot assembly may further include a nozzle for injecting one of assist air or gaseous fuel into the longitudinal passageway. The nozzle may be positioned at the flow restriction section or on an upstream side of the flow restriction section.

In another aspect, a method of operating a fuel injector of a gas turbine engine is disclosed. The fuel injector may be configured to direct a stream of fuel-air mixture to a combustor of the turbine engine through a pilot assembly and a separate stream of fuel-air mixture to the combustor through an annular duct disposed circumferentially about the pilot assembly. The pilot assembly may include a centrally located longitudinal passageway having an outlet end proximate the combustor. The method may include injecting liquid fuel into the pilot assembly through a liquid fuel nozzle. The liquid fuel nozzle may be positioned so as to direct a mixture of liquid fuel and air proximate the outlet end of the longitudinal passageway. The method may also include delivering compressed air to the longitudinal passageway through a compressed air inlet, and directing the compressed air towards the outlet end through a flow restriction section of the longitudinal passageway. The flow restriction section may be a narrowed section of the longitudinal passageway that is configured to decrease a pressure and increase a velocity of the compressed air flowing therethrough. The method may further include deactivating a flow of one of a gaseous fuel or assist air through a nozzle. The nozzle may be positioned proximate the flow restriction section of the longitudinal passageway.

In yet another aspect, a fuel injector for a gas turbine engine is disclosed. The fuel injector may include a tubular premix barrel disposed circumferentially about a longitudinal axis and a pilot assembly positioned radially inwards of the premix barrel such that an annular duct is defined between the premix barrel and the pilot assembly. The pilot assembly may include a longitudinal passageway extending into the pilot assembly along the longitudinal axis, and a compressed air inlet that is configured to discharge compressed air into the longitudinal passageway. The pilot assembly may also include a flow restriction section of the longitudinal passageway. The flow restriction section may be positioned downstream of the compressed air inlet and configured to decrease a pressure and increase a velocity of the compressed air flowing therethrough. The pilot assembly may also include a nozzle that is positioned in the longitudinal passageway proximate the flow restriction section. A location of the nozzle in the longitudinal passageway may be such that a pressure drop of the compressed air in the longitudinal passageway downstream of the nozzle is greater than or equal to an expected combustion induced pressure variation in a combustor of the gas turbine engine. The nozzle may be configured to inject one of gaseous fuel or assist air into the longitudinal passageway. The pilot assembly may further include a liquid fuel nozzle positioned downstream of the gas fuel nozzle. The liquid fuel nozzle may be configured to inject a liquid fuel into the pilot assembly.

DETAILED DESCRIPTION

Figure 1:
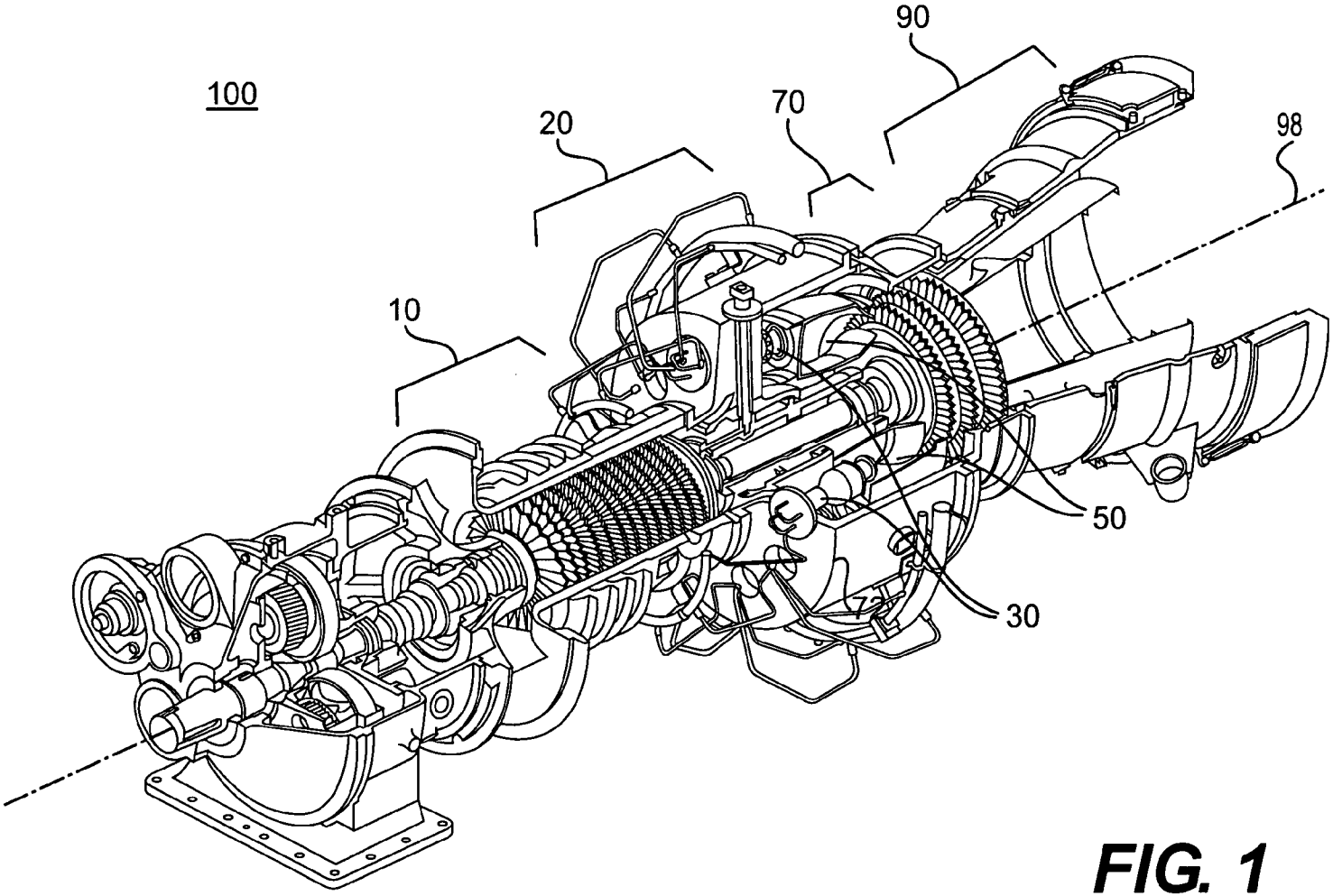
FIG. 1 is an illustration of an exemplary disclosed gas turbine engine (GTE) system.

FIG. 1 illustrates an exemplary gas turbine engine (GTE) 100. GTE 100 may have, among other systems, a compressor system 10, a combustor system 20, a turbine system 70, and an exhaust system 90 arranged along an engine axis 98. Compressor system 10 may compress air to a compressor discharge pressure and deliver the compressed air to an enclosure 72 of combustor system 20. The compressed air may then be directed from enclosure 72 into one or more fuel injectors 30 positioned therein. The compressed air may be mixed with a fuel in fuel injector 30, and the mixture may be directed to a combustor 50. The fuel-air mixture may ignite and burn in combustor 50 to produce combustion gases at a high temperature and pressure. These combustion gases may be directed to turbine system 70. Turbine system 70 may extract energy from these combustion gases, and direct the exhaust gases to the atmosphere through exhaust system 90. The layout of GTE 100 illustrated in FIG. 1, and described above, is only exemplary and fuel injectors 30 of the current disclosure may be used with any configuration and layout of GTE 100.

Figure 2:
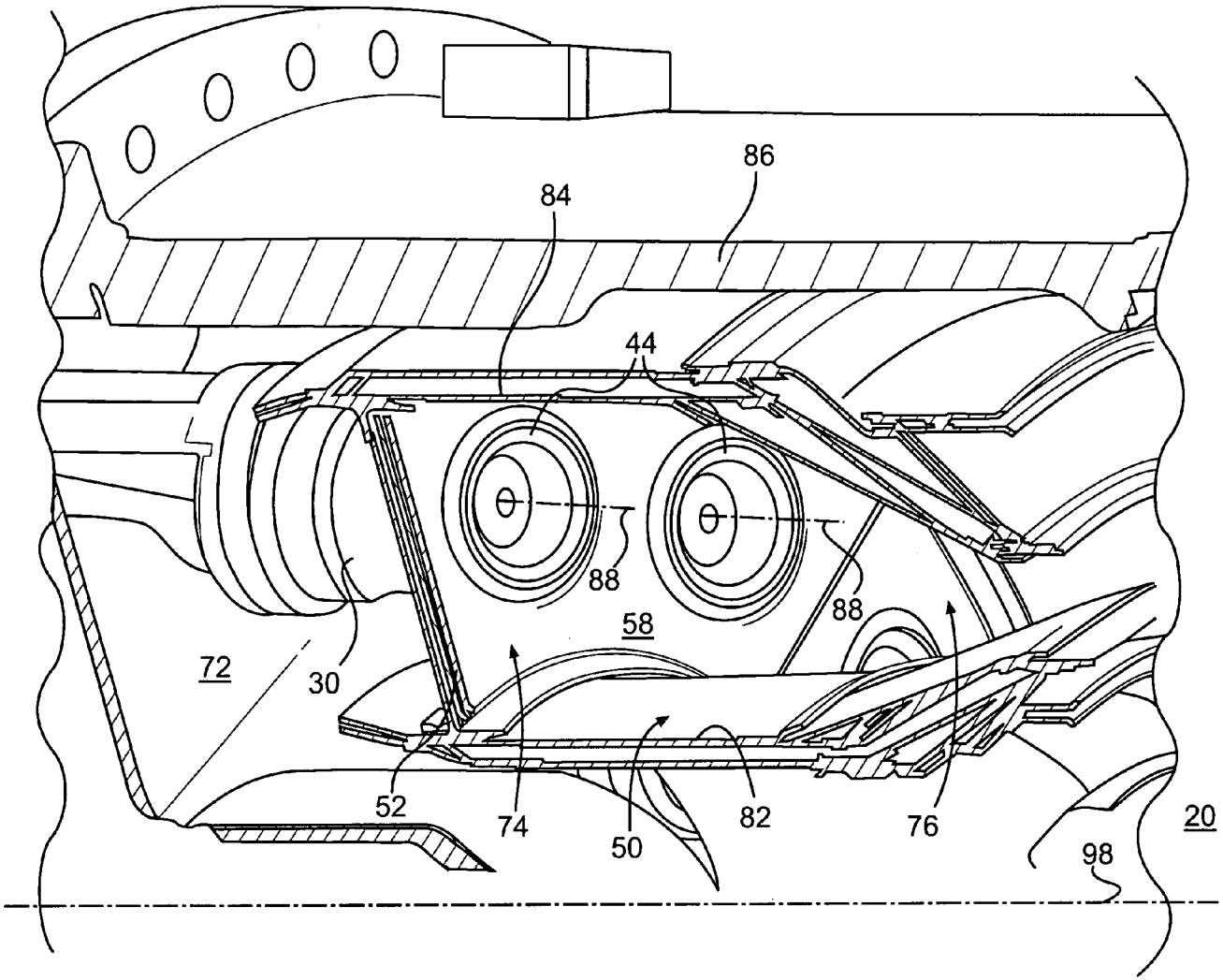
FIG. 2 is a cut-away view of a combustor system of the GTE of FIG. 1.

FIG. 2 is a cut-away view of combustor system 20 showing a plurality of fuel injectors 30 fluidly coupled to combustor 50. Combustor 50 may be positioned within an outer casing 86 of combustor system 20, and may be annularly disposed about engine axis 98. Outer casing 86 and combustor 50 may define the enclosure 72 between them. As indicated earlier, enclosure 72 may contain compressed air at compressor discharge pressure. Combustor 50 may include an inner liner 82 and an outer liner 84 joined at an upstream end 74 by a dome assembly 52. Inner liner 82 and outer liner 84 may define a combustor volume 58 between them. Combustor volume 58 may be an annular space bounded by inner liner 82 and outer liner 84 that extends from upstream end 74 to a downstream end 76, along engine axis 98. Combustor volume 58 may be fluidly coupled to turbine system 70 at the downstream end 76. A plurality of fuel injectors 30 may be positioned on dome assembly 52 symmetrically about engine axis 98, such that a longitudinal axis 88 of each fuel injector 30 may be substantially parallel to engine axis 98. These fuel injectors 30 may be oriented such that a first end 44 of each fuel injector 30 fluidly couples the fuel injector 30 to combustor volume 58. Although the embodiment of FIG. 2 includes twelve fuel injectors 30, in general, the number of fuel injectors 30 positioned on dome assembly 52 may depend upon the application.

During operation, a fuel-air mixture may be directed to combustor volume 58 through first end 44 of each fuel injector 30. Upon entry into combustor volume 58, this fuel-air mixture may ignite and create a plume of flame proximate upstream end 74 of combustor volume 58 (mouth of the fuel injector). Combustion of the fuel-air mixture may create combustion gases at a high temperature and pressure. These combustion gases may be directed to turbine system 70 through an opening at the downstream end 76 of combustor 50. Variations in the fuel-air mixture (variations in volume, concentration of fuel, etc.) directed to combustor volume 58 by different fuel injectors 30 and possibly other factors, may cause variations in the intensity of the flame produced at the mouth of different fuel injectors 30. This variation in intensity of the flame may give rise to variations in pressure at the mouth of different fuel injectors 30, thereby inducing a circumferential pressure variation in combustor volume 58. The circumferential variation in pressure in combustor volume 58 may, in some cases, tend to induce cross-talk. The paragraphs below describe how the disclosed fuel injectors reduce cross-talk.

Figure 3:
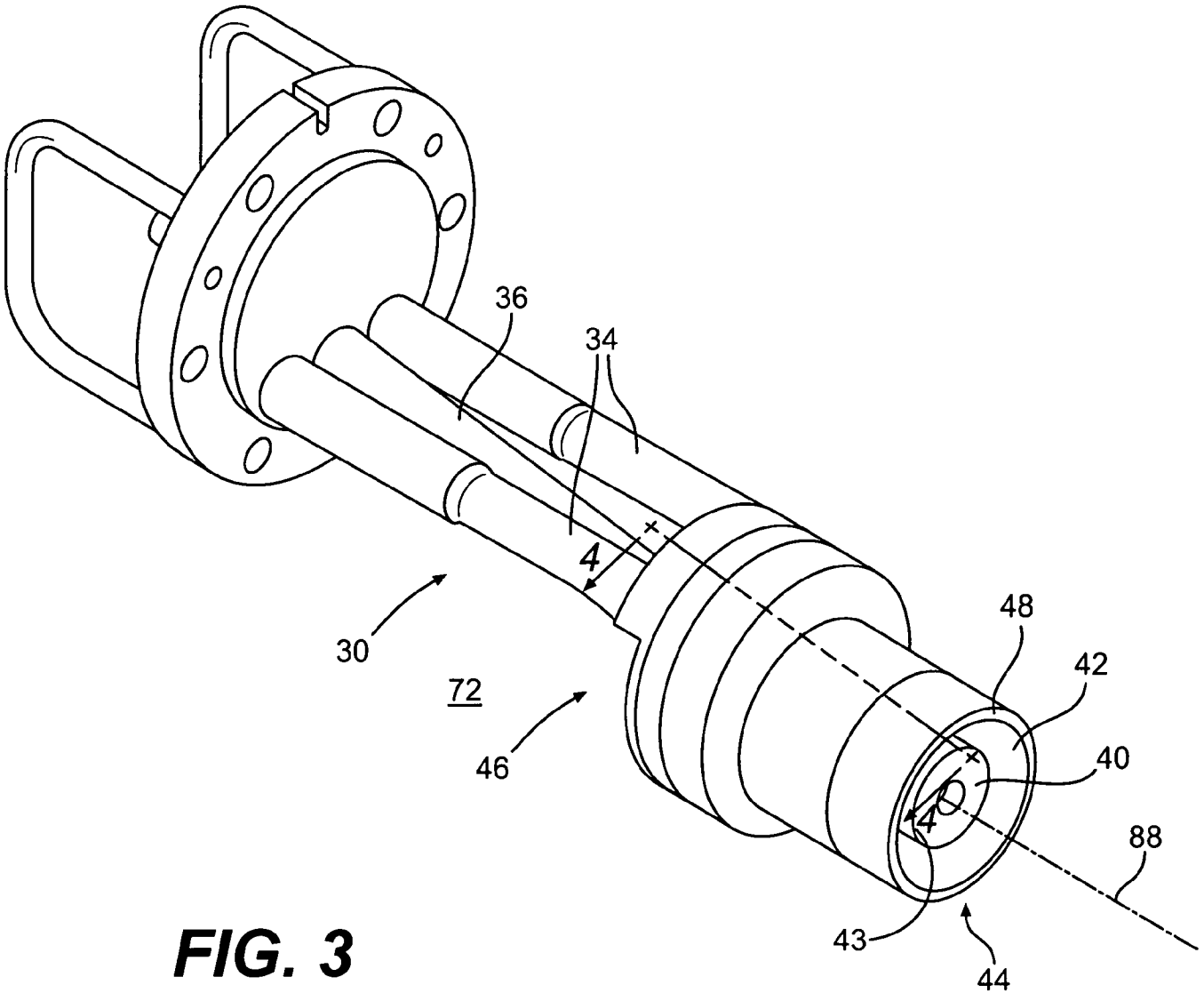
FIG. 3 illustrates a fuel injector of the GTE of FIG. 1.

FIG. 3 is an illustration of an embodiment of fuel injector 30 that may reduce cross-talk. Fuel and compressed air may be delivered to fuel injector 30 through second end 46. This fuel and air may be mixed together and directed to combustor 50 through first end 44. To reduce $NO_x$ emissions of GTE 100, while maintaining a stable flame in combustor 50, fuel injector 30 may direct multiple streams of fuel-air mixture to combustor 50. These separate streams of fuel-air mixture may include a main fuel stream and a pilot fuel stream. Main fuel stream may include a lean fuel-air mixture (that is, a fuel-air mixture lean in fuel) and the pilot fuel stream may include a fuel-air mixture that is richer in fuel. The lean fuel-air mixture, directed into combustor 50 as the main fuel stream, may burn in combustor 50 to produce a low temperature flame. The $NO_x$ emissions of GTE 100 operating on a lean fuel-air mixture may be low. However, in some cases, the low temperature flame may be unstable. The richer fuel-air mixture directed to combustor 50 as the pilot fuel stream may burn at a higher temperature and may serve to stabilize the combustion process at the cost of slightly increased $NO_x$ emissions. To minimize $NO_x$ emissions while maintaining the stability of the combustion process, a control system (not shown) of GTE 100 may activate (or increase) the flow of pilot fuel-air mixture when an unstable combustion event is detected.

The pilot fuel-air mixture may be directed to combustor 50 through a pilot assembly 40 centrally located on fuel injector 30. Fuel injector 30 may also include a tubular premix barrel 48 circumferentially disposed about a housing 43 of pilot assembly 40. The main fuel-air mixture may be directed to combustor 50 through an annular duct 42 defined between housing pilot assembly 40 and premix barrel 48. Fuel injector 30 may be a dual fuel injector that may be configured to selectively deliver a gaseous fuel or a liquid fuel to combustor 50. The fuel delivered to fuel injector 30 may be switched between a gaseous and a liquid fuel to suit the operating conditions of GTE 100. For instance, at an operating site with an abundant supply of natural gas, fuel injector 30 may deliver liquid fuel to combustor 50 during start up and later switch to natural gas fuel to utilize the locally available fuel supply. To accommodate the delivery of both liquid and gaseous fuels to combustor 50, pilot assembly 40 and annular duct 42 may include both liquid and gaseous fuel delivery systems.

Liquid fuel line 36 and gaseous fuel lines 34 may deliver liquid and gaseous fuel to second end 46 of fuel injector 30 from liquid and gas fuel manifolds (not shown) of GTE 100. Compressed air may also be directed into fuel injector 30 from enclosure 72, through openings (not visible in FIG. 3) at second end 46 of fuel injector 30. The liquid fuel, gaseous fuel, and compressed air may be directed to both pilot assembly 40 and annular duct 42 to form the pilot fuel-air mixture and the main fuel-air mixture that may be directed to combustor 50 through first end 44. Since the functioning of fuel injectors are known in the art, for the sake of brevity, only those aspects of fuel injector 30 that may be useful in describing the novel aspects of the current disclosure will be described herein.

Figure 4:
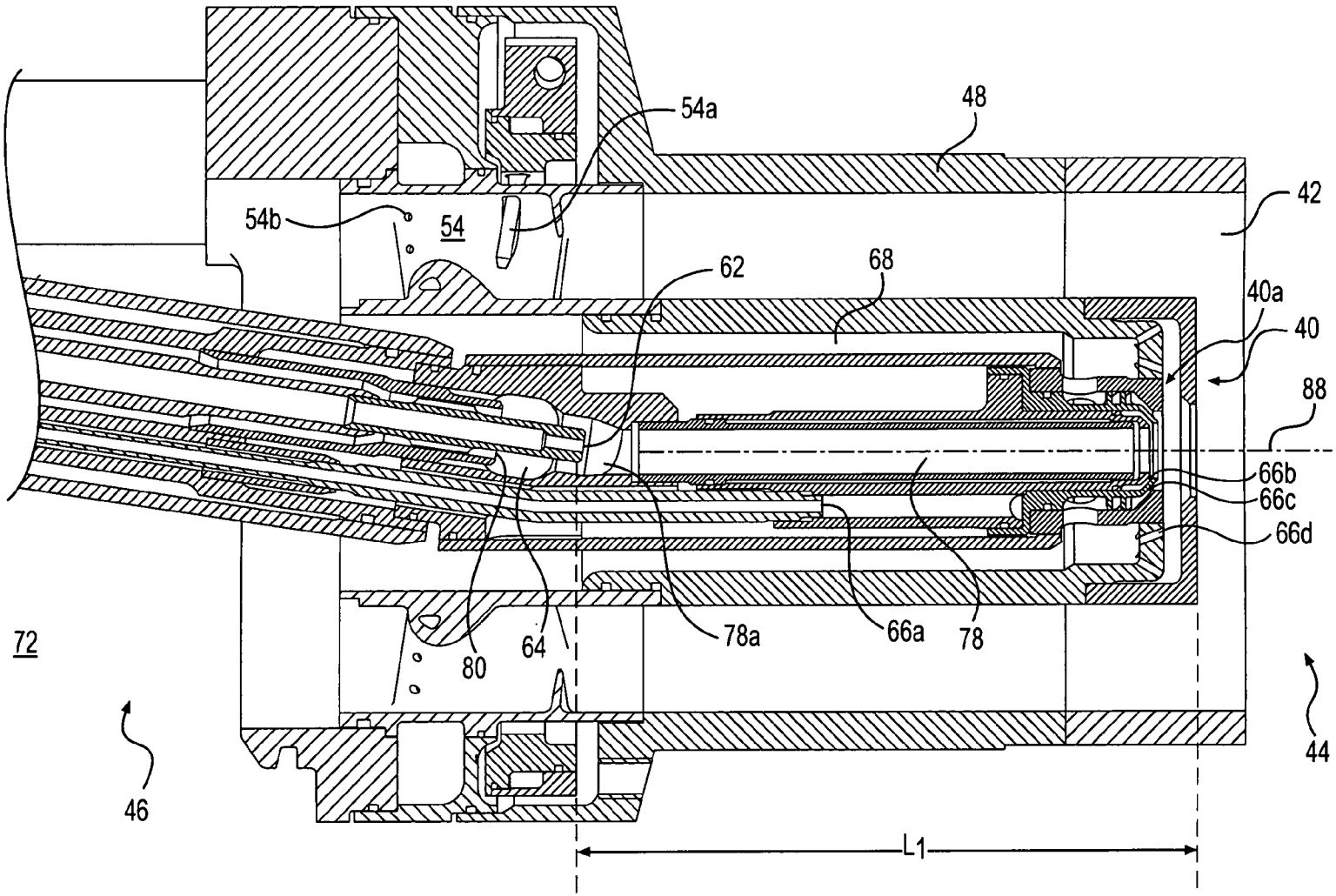
FIG. 4 is a cross-sectional view of the fuel injector of FIG. 3.

FIG. 4 is a cross-sectional illustration of fuel injector 30 along plane 4 of FIG. 3. Proximate second end 46, annular duct 42 may include an air swirler 54 configured to impart a swirl to compressed air entering annular duct 42 from enclosure 72. Air swirler 54 may include a main liquid injection spoke 54*a* configured to spray a stream of liquid fuel into the swirled compressed air stream flowing past air swirler 54. Air swirler 54 may also include a plurality of main gas orifices 54*b* configured to inject gaseous fuel into the swirled air stream. Depending upon the type of fuel the fuel injector 30 is operating on, one of liquid fuel or gaseous fuel may be delivered to the compressed air in annular duct 42. This fuel (liquid or gaseous) may mix with the compressed air, flow through the annular duct 42, and enter combustor 50 through first end 44.

Pilot assembly 40 may also include components that direct a fuel-air mixture to combustor 50. These components may include, among others, a liquid fuel nozzle 66, a gas fuel nozzle 62 and an air assist nozzle 80. Liquid fuel nozzle 66 may deliver liquid fuel and gas fuel nozzle 62 may deliver a gaseous fuel to pilot assembly 40. During engine startup, when GTE 100 operates on liquid fuel, air assist nozzle 80 may deliver supplemental air to pilot assembly 40. This assist air may help in atomizing the liquid fuel in the fuel-air mixture directed to combustor 50 through pilot assembly 40. Compressed air from enclosure 72, at substantially the compressor discharge pressure, may also enter pilot assembly 40 through second end 46. This compressed air may flow towards combustor 50 through an annular outer passageway 68 of pilot assembly 40. A portion of the compressed air from outer passageway 68 may also be directed into a longitudinal passageway 78 (using conduits that run in and out of the page in FIG. 4) through a compressed air inlet 64. Longitudinal passageway 78 may be a centrally located cavity that extends into pilot assembly 40 along longitudinal axis 88. The compressed air entering longitudinal passageway 78 through compressed air inlet 64 may be at substantially the compressor discharge pressure. Although the conduits that direct compressed air to the compressed air inlet 64 and the longitudinal passageway 78 may be designed to prevent a reduction in pressure of the compressed air, it is contemplated that in practice the pressure of the compressed air entering longitudinal cavity 78 through compressed air inlet 64 may be slightly lower than the compressor discharge pressure. This high pressure air may flow towards combustor 50 through longitudinal passageway 78. As the compressed air flows towards combustor 50 through longitudinal passageway 78, the compressed air may pass through a flow restriction region (narrowed region 78*a*) of longitudinal passageway 78. Flow restriction region constitutes a part of longitudinal passageway 78 which transitions from a larger cross-sectional flow area to a smaller cross-sectional flow area. As the compressed air flows past the narrowed region 78*a*, the air may experience a drop in pressure and a concomitant increase in velocity.

The liquid fuel delivered to pilot assembly 40 through a liquid fuel tube 66*a* may be sprayed into combustor 50 through a pilot liquid fuel nozzle 66*b* positioned at pilot tip 40*a*. A portion of the compressed air flowing through outer passageway 68 may also be injected into combustor 50 alongside the liquid fuel spray through an air nozzle 66*c* positioned on pilot tip 40*a*. The remaining compressed air in outer passageway 68 may be injected through impingement cooling holes 66*d* to cool the tip of the pilot assembly 40 proximate the combustor 50. The liquid fuel and compressed air delivered through pilot assembly 40 may mix and burn in the combustor 50 proximate first end 44. For good atomization of the liquid fuel during engine startup, air assist nozzle 80 may direct lower pressure shop air into pilot assembly 40. After startup, the air flow through the air assist nozzle 80 may be stopped and the air assist nozzle 80 deactivated (turned off). In this operating state, both air assist nozzle 80 and gas fuel nozzle 62 may be deactivated.

When GTE 100 operates on gaseous fuel, liquid fuel nozzle 66*b* and air assist nozzle 80 may be deactivated and a mixture of gaseous fuel and air may be directed to combustor 50 through pilot assembly 40. The gaseous fuel may be directed to pilot assembly 40 through gas fuel nozzle 62. The gaseous fuel may mix with compressed air in longitudinal passageway 78 and flow towards combustor 50. Gas fuel nozzle 62 and air assist nozzle 80 may be positioned in longitudinal passageway 78 proximate compressed air inlet 64. In some embodiments, gas fuel nozzle 62 may be positioned in the narrowed region 78*a* of longitudinal passageway 78. As the gaseous fuel from gas fuel nozzle 62 mixes with the compressed air and flows towards combustor 50, the mixture may experience a further pressure drop, due to resistance in the longitudinal passageway 78. In some cases, the total pressure drop of compressed air in pilot assembly 40 may be about 4%. For instance, for a GTE 100 having a compressor discharge pressure of about 230 psi, the pressure drop of compressed air from compressed air inlet 64 to combustor 50 may be about 10 psi.

A nozzle may be deactivated by closing a valve that delivers the fuel or assist air to a respective fuel or air assist manifold. For instance, when GTE 100 operates on liquid fuel, a valve on the pilot gas fuel manifold (and a valve on the air assist manifold when GTE 100 is not being started) may be closed to prevent gaseous fuel and assist air from flowing to pilot assembly 40. Although gaseous fuel and assist air may be prevented from flowing to pilot assembly 40 by closing these valves, gas fuel nozzles 62 and air assist nozzles 80 of different fuel injectors 30 may still be fluidly coupled together through their respective common manifolds. When the gas fuel nozzle 62 and/or the air assist nozzle 80 are deactivated, the circumferential pressure variation in the combustor 50 (set up due to the variation in intensity of the flame at the mouth of different fuel injectors 30) may cause some of the liquid fuel and/or combustion gases from combustor 50 to enter the deactivated nozzles of a fuel injector 30 at a high pressure location, and exit out of the deactivated nozzles of another fuel injector 30 located at a lower pressure location. That is, the combustion induced circumferential pressure variation may induce cross-talk through the deactivated fuel and/or air assist nozzles.

In prior art fuel injectors, gas fuel nozzle 62, air assist nozzle 80, and liquid fuel nozzle 66*b* may be positioned proximate to each other. In these fuel injectors, when GTE 100 operates on liquid fuel, and when gas fuel nozzle 62 and air assist nozzle 80 are inactive, the inactive nozzles may ingest uncombusted liquid fuel and/or combustion gases. This ingested liquid fuel may accumulate in the fuel lines and get ignited when they come into contact with ingested hot combustion gases. In fuel injectors of the current disclosure, the gas fuel nozzle 62 and air assist nozzle 80 are positioned away from liquid fuel nozzle 66*b* and combustor 50, and upstream of a flow of a high volume of high pressure air. Because of this positioning, the liquid fuel and combustion gases will have to flow upstream against the flow of this high volume of high pressure air to reach the gas fuel nozzle 62 and air assist nozzle 80. Further more, since these nozzles are positioned away from combustor 50, the combustion induced circumferential pressure variation at these locations may be lower. Therefore, the likelihood of cross-talk in fuel injectors of the current disclosure may be lower than in fuel injectors of the prior art. Even if a small amount of cross-talk does occur in these fuel injectors, due to the positioning of the nozzles, only clean compressor discharge air may be ingested by the inactive nozzles due to the high pressure air surrounding these nozzles.

In the embodiment of fuel injector 30 illustrated in FIG. 4, the air assist nozzle 80 and gas fuel nozzle 62 are positioned proximate compressed air inlet 64. That is, gas fuel nozzle 62 is positioned in the narrowed region 78*a* of longitudinal passageway 78 and air assist nozzle 80 is positioned on the upstream side of the narrowed region 78*a*. In fuel injector 30 of FIG. 4, the pressure drop of compressed air between these nozzles (air assist nozzle 80 and gas fuel nozzle 62) and pilot tip 40*a* may be substantially the same as the pressure drop of compressed air between compressed air inlet 64 and pilot tip 40*a*. Furthermore, since air assist nozzle 80 is positioned upstream of the gas fuel nozzle 62 in fuel injector 30 of FIG. 4, the likelihood of a deactivated air assist nozzle 80 ingesting gaseous fuel, when fuel injector 30 is operating on gaseous fuel and the deactivated air assist nozzle 80 is suffering from cross-talk, is also minimized. By positioning air assist nozzle 80 upstream of the gas fuel nozzle 62 and proximate the compressed air inlet 64 a deactivated air assist nozzle 80 may only ingest compressed air even if cross-talk were to occur.

In general, gas fuel nozzle 62 may be positioned in longitudinal passageway 78 at a distance of about $L_1$ from pilot tip 40*a*. Pressure drop of the compressed air between gas fuel nozzle 62 and pilot tip 40*a* may depend upon distance $L_1$. An increase of distance $L_1$ may increase the pressure drop and a decrease of distance $L_1$ may decrease the pressure drop. In embodiments, where gas fuel nozzle 62 is located at a substantial distance downstream of compressed air inlet 64, the pressure drop of the compressed air between gas fuel nozzle 62 and pilot tip 40*a* may be substantially lower than the pressure drop of the compressed air between compressed air inlet 64 and pilot tip 40*a*. Distance $L_1$ may depend upon the application, and may be selected based on a desired pressure drop between gas fuel nozzle 62 and pilot tip 40*a*. For instance, $L_1$ may be chosen such that the pressure drop of compressed air passing through longitudinal passageway 78, between gas fuel nozzle 62 and pilot tip 40*a*, may be greater than or equal to any expected circumferential pressure variation in combustor 50. In some embodiments of fuel injector 30, distance $L_1$ may vary from about 0.5 inches to about 10 inches. In some embodiments, distance $L_1$ may vary between about 2 inches to about 6 inches. It should be emphasized that these values of $L_1$ are exemplary only, and in general, air assist nozzle 80 and gas fuel nozzle 62 may be positioned such that the pressure drop of compressed air between these nozzles and pilot tip 40*a* is greater than or equal to an expected combustion induced pressure variation in combustor 50.

INDUSTRIAL APPLICABILITY

The presently disclosed fuel injector may be utilized to reduce the likelihood of cross-talk in a gas turbine engine. Positioning the pilot gas fuel nozzle and the air assist nozzle of the fuel injector proximate a high pressure compressed air discharge, and away from the combustor and pilot liquid fuel nozzle, may reduce the likelihood of cross-talk through the pilot assembly of the fuel injector. In the pilot assembly, a high velocity stream of compressed air flows from the compressed air discharge to the combustor. The pilot gas fuel nozzle and the air assist nozzle may be positioned such that the pressure drop of compressed air between these nozzles and the combustor is greater than or equal to an expected combustion induced pressure variation in the combustor.

To operate efficiently in a variety of locations, a gas turbine engine may operate using selectively either liquid fuel or gaseous fuel. The fuel injectors of such a gas turbine engine may selectively deliver the liquid fuel or the gaseous fuel to the combustor through liquid fuel nozzles or gaseous fuel nozzles. Since the fuel injector may only direct one type of fuel to the combustor at any one time, one of the liquid fuel nozzles or the gaseous fuel nozzles may be inactive at any time. Minor variations in fuel-air mixture directed to the combustor through different fuel injectors may cause variations in pressure proximate different fuel injectors within the combustor. These pressure variations may induce cross-talk between the inactive fuel nozzles of different fuel injectors.

Due to the positioning of the fuel and air assist nozzles in the pilot assembly, liquid fuel and combustion gases will have to flow upstream against the flow of a high volume of high pressure air to reach an inactive gas fuel nozzle and air assist nozzle. Furthermore, since the gas fuel nozzle and the air assist nozzle are positioned away from combustor, the combustion induced circumferential pressure variation at these locations may be lower. Therefore, the likelihood of cross-talk in fuel injectors of the current disclosure may be lower than in fuel injectors of the prior art. Even if a small amount of cross-talk does occur, since high pressure compressor discharge air surrounds the pilot gas fuel nozzle and air assist nozzle, only clean compressor discharge air may be ingested by the inactive nozzles.

It will be apparent to those skilled in the art that various modifications and variations can be made to the disclosed gas turbine fuel injector. Other embodiments will be apparent to those skilled in the art from consideration of the specification and practice of the disclosed low cross-talk gas turbine fuel injector. It is intended that the specification and examples be considered as exemplary only, with a true scope being indicated by the following claims and their equivalents.

We claim:

1. A pilot assembly for a fuel injector of a gas turbine engine, comprising:

a longitudinal passageway having an outlet end, a mass flow in the longitudinal passageway generally flowing towards the outlet end during operation of the engine;

a liquid fuel nozzle positioned radially outwardly of the longitudinal passageway and configured to direct a mixture of liquid fuel and air around the outlet end of the longitudinal passageway;

a compressed air inlet, the compressed air inlet being configured to direct air compressed by a compressor of the engine to a compressor discharge pressure into the longitudinal passageway without a substantial loss of pressure;

a flow restriction section, the flow restriction section being a narrowed section of the longitudinal passageway, wherein an upstream side of the flow restriction section includes compressed air at substantially the compressor discharge pressure and a downstream side includes air at a lower pressure and a higher velocity;

a gas fuel nozzle configured to inject a gaseous fuel into the longitudinal passageway at the flow restriction section; and an air assist nozzle configured to direct assist air into the longitudinal passageway upstream of the flow restriction section.

2. The pilot assembly of claim 1, wherein at least one of the gas fuel nozzle and the air assist nozzle is inactive during operation of the engine on liquid fuel.

3. The pilot assembly of claim 1, wherein the gas fuel nozzle is positioned at a distance of about 2 inches to about 6 inches from the outlet end.

4. The pilot assembly of claim 1, wherein the air assist nozzle is configured to direct assist air which is different from, and at a lower pressure than, the air compressed by the compressor of the engine into the longitudinal passageway.

5. The pilot assembly of claim 4, wherein the air assist nozzle is configured to direct assist air into the longitudinal passageway around the gas fuel nozzle.

6. The pilot assembly of claim 1, wherein at the flow restriction section, boundary walls of the longitudinal passageway converge inwardly to reduce a cross-sectional area available for fluid flow.

7. A method of reducing cross-talk through a fuel injector of a gas turbine engine, the cross-talk occurring as a result of combustion induced pressure variation in a combustor of the turbine engine, the fuel injector being configured to direct a stream of fuel-air mixture to the combustor through a pilot assembly and a separate stream of fuel-air mixture to the combustor through an annular duct disposed circumferentially about the pilot assembly, the pilot assembly including a centrally located longitudinal passageway having an outlet end fluidly coupled to the combustor, comprising:

directing a liquid fuel into the combustor through the pilot assembly around the outlet end of the longitudinal passageway;

delivering compressed air to the longitudinal passageway through a compressed air inlet upstream of a flow restriction section of the longitudinal passageway, the flow restriction section being a narrowed section of the longitudinal passageway that is configured to decrease a pressure and increase a velocity of the compressed air flowing therethrough;

directing a gaseous fuel into the longitudinal passageway at the flow restriction section; and directing the compressed air delivered through the compressed air inlet to the combustor such that a pressure drop of the compressed air in the longitudinal passageway downstream of the flow restriction section is greater than or equal to an expected combustion induced pressure variation in the combustor.

8. The method of claim 7, wherein delivering compressed air to the longitudinal passageway includes delivering compressed air at a pressure substantially equal to a discharge pressure of a compressor of the gas turbine engine.

9. The method of claim 7, wherein the gas fuel nozzle is positioned at a distance of about 0.5 inches to about 10 inches from the outlet end.

10. The method of claim 7, wherein the gas fuel nozzle is positioned at a distance of about 2 inches to about 6 inches from the outlet end.

11. The method of claim 7, wherein the gas fuel nozzle is positioned in the longitudinal passageway such that the compressed air from the compressed air inlet flows substantially around the gas fuel nozzle.

12. The method of claim 7, further including deactivating the directing of the liquid fuel through the pilot assembly before directing the gaseous fuel into the longitudinal passageway.

13. The method of claim 7, further including directing assist air into the longitudinal passageway upstream of the compressed air inlet, the assist air being air that is different from, and at a lower pressure that, the compressed air directed into the longitudinal passageway through the compressed air inlet.

14. A fuel injector for a gas turbine engine, comprising:

a tubular premix barrel disposed circumferentially about a longitudinal axis; and a pilot assembly positioned radially inwards of the premix barrel such that an annular duct is defined between the premix barrel and the pilot assembly, the pilot assembly including, a longitudinal passageway extending into the pilot assembly along the longitudinal axis, the longitudinal passageway including a compressed air inlet configured to discharge compressed air into the longitudinal passageway, a flow restriction section of the longitudinal passageway, the flow restriction section being positioned downstream of the compressed air inlet and being configured to decrease a pressure and increase a velocity of the compressed air flowing therethrough, a nozzle positioned in the longitudinal passageway proximate the flow restriction section, a location of the nozzle in the longitudinal passageway being such that a pressure drop of the compressed air in the longitudinal passageway downstream of the nozzle is greater than or equal to an expected combustion induced pressure variation in a combustor of the gas turbine engine, the nozzle being configured to inject one of gaseous fuel or assist air into the longitudinal passageway; and a liquid fuel nozzle positioned radially outwardly from the longitudinal passageway and downstream of the nozzle, the liquid fuel nozzle being configured to inject a liquid fuel into the pilot assembly.

15. The fuel injector of claim 14, wherein the compressed air inlet is configured to discharge compressed air at a pressure substantially equal to a discharge pressure of a compressor of the gas turbine engine into the longitudinal passageway.

16. The fuel injector of claim 14, wherein the nozzle is a gas fuel nozzle configured to inject the gaseous fuel into the longitudinal passageway and positioned at the flow restriction section of the longitudinal passageway.

17. The fuel injector of claim 16, wherein the fuel injector is configured to selectively deactivate one of the liquid fuel nozzle and the gas fuel nozzle while the gas turbine engine is operating.

18. The fuel injector of claim 16, wherein the gas fuel nozzle is positioned in the longitudinal passageway at a distance of about 2 inches to about 6 inches from an outlet of the longitudinal passageway into the combustor.

19. The fuel injector of claim 14, wherein the nozzle is an air assist nozzle configured to direct assist air into the longitudinal passageway and positioned upstream of the compressed air inlet, the assist air being different from, and at a lower pressure than, the compressed air directed into the longitudinal passageway through the compressed air inlet.

20. The fuel injector of claim 14, wherein at the flow restriction section, boundary walls of the longitudinal passageway converge inwardly to reduce a cross-sectional area available for fluid flow.

* * * * *